US005224854A

United States Patent [19]

Ansquer

[11] Patent Number: 5,224,854

[45] Date of Patent: Jul. 6, 1993

[54] SAFETY LIGHTER

[75] Inventor: Henri Ansquer, Quimper, France

[73] Assignee: SIBJET - Societ',acu/e/ Industrielle du Briquet Jetable, Paris, France

[21] Appl. No.: 439,260

[22] Filed: Nov. 17, 1989

[30] Foreign Application Priority Data

Jul. 7, 1988 [FR] France ..... 88 08912
Jul. 11, 1988 [FR] France ..... 88 109387
Jun. 29, 1989 [WO] PCT Int'l Appl. ..... PCT/FR89/00339

[51] Int. Cl.[5] ..... F23D 11/36
[52] U.S. Cl. ..... 431/153; 431/277
[58] Field of Search ..... 431/153, 277, 129, 142, 431/144; 222/153, 402.11, 384; 251/77, 78

[56] References Cited

U.S. PATENT DOCUMENTS

| | | | |
|---|---|---|---|
| 1,895,032 | 1/1933 | Fisher . | |
| 2,520,328 | 8/1950 | Nissen | 67/7.1 |
| 2,727,376 | 12/1955 | Felt | 67/7.1 |
| 3,169,672 | 2/1965 | Soffer | 222/153 |
| 3,859,035 | 1/1975 | Schlamp | 431/255 |
| 3,924,782 | 12/1975 | Starrett | 222/402.11 |
| 3,938,943 | 2/1976 | Malamoud | 431/150 |
| 3,961,876 | 6/1976 | Chernock | 431/344 |
| 4,024,988 | 5/1977 | Starrett | 222/153 |
| 4,028,043 | 6/1977 | Neyret | 431/144 |
| 4,049,370 | 9/1977 | Neyret | 431/144 |
| 4,157,891 | 6/1979 | Moriya | 431/344 |
| 4,243,377 | 1/1981 | Schmid | 431/344 |
| 4,295,819 | 10/1981 | Sugiyama | 431/143 |
| 4,332,549 | 6/1982 | Fuller | 431/344 |
| 4,403,945 | 9/1983 | Leitgib | 431/150 |
| 4,432,542 | 2/1984 | Poynter | 272/27 |
| 4,471,404 | 9/1984 | Nitta | 361/247 |
| 4,496,309 | 1/1985 | Schachter | 431/344 |
| 4,516,933 | 5/1985 | Buzzi | 431/255 |
| 4,560,345 | 12/1985 | Schachter | 431/344 |
| 4,569,654 | 2/1986 | Borghesi | 431/255 |
| 4,595,352 | 6/1986 | Endelson | 431/254 |
| 4,773,849 | 9/1988 | Schachter | 431/344 |
| 4,784,602 | 11/1988 | Nitta . | |
| 4,786,248 | 11/1988 | Nitta | 431/153 |
| 4,830,603 | 5/1989 | Cirami | 431/277 |
| 4,859,172 | 8/1989 | Nitta | 431/153 |
| 4,869,662 | 9/1989 | LeCourt et al. | 431/144 |
| 4,869,663 | 9/1989 | Fremund | 431/153 |
| 4,878,836 | 11/1989 | Nitta | 431/277 |
| 4,885,965 | 12/1989 | Nitta | 431/277 |
| 4,889,482 | 12/1989 | Schachter | 431/344 |
| 4,904,180 | 2/1990 | Nitta | 431/153 |
| 4,921,420 | 5/1990 | Johnston | 431/153 |
| 4,992,042 | 2/1991 | Knuepfer | 431/253 |
| 5,002,482 | 3/1991 | Fairbanks et al. | 431/153 X |

FOREIGN PATENT DOCUMENTS

| | | |
|---|---|---|
| 372173 | 9/1983 | Austria . |
| 1145658 | 5/1983 | Canada . |
| 0296281 | 8/1987 | European Pat. Off. . |
| 0285748 | 10/1988 | European Pat. Off. . |
| 0312627 | 4/1989 | European Pat. Off. . |
| 3040596 | 5/1981 | Fed. Rep. of Germany . |
| 8802582 | 4/1988 | Fed. Rep. of Germany . |
| 2220047 | 7/1974 | France . |
| 2280029 | 2/1976 | France . |
| 2465161 | 3/1981 | France . |
| 2468838 | 5/1981 | France . |
| 56-085638 | 7/1981 | Japan . |
| 636943 | 6/1983 | Switzerland . |
| 2062200 | 5/1981 | United Kingdom . |
| 2072820 | 10/1981 | United Kingdom . |
| 8100752 | 3/1981 | World Int. Prop. O. . |

*Primary Examiner*—Carl D. Price
*Attorney, Agent, or Firm*—Harry C. Marcus; Eugene C. Rzucidlo; Gabriel P. Kralik

[57] ABSTRACT

A safety catch (11) is moveable in a slot (25) of the lighter body (1) and a pushbutton (7) thereon cannot be pressed down unless the catch (11) is in a central position, with a spring returning the catch to the safe position automatically.

19 Claims, 3 Drawing Sheets

SAFETY LIGHTER

This application is a continuation of the international application corresponding to PCT/FR89/00339, filed Jun. 29, 1989, which designated the United States and is now abandoned.

This application claims priority to the French national applications corresponding to PCT/FR89/00339 (FR 88 08912 filed Jul. 1, 1988, and FR88 09387 filed Jul. 11, 1988) under 35 U.S.C. §119 , and continuation priority to the copending U.S. application corresponding to PCT/FR89/00339 under 35 U.S.C. §120.

The present invention relates to a safety lighter providing safety operation, being capable of lighting only after a cocking operation.

Currently manufactured gas lighters generally comprise a supply of liquified gas, an expander, a burner, and a flint-and-striking-wheel lighting assembly. The burner is moveable in translation, and depending on its position, expanded gas is allowed to flow or is prevented from flowing. It is known that the motion of the burner can be controlled by means of a tilting pushbutton on which the user's thumb bears, with burner motion taking place after causing the striking wheel to rotate (which wheel is in contact with the flint in conventional lighting). The tilting motion of the pushbutton raises the burner head, thereby allowing expanded gas to rise into the sparks. When piezoelectric lighting is used, then the sparks are generated by applying pressure to a pushbutton which is a sliding member and which also allows gas to flow.

In general, manufacturers have sought to make lighting a lighter as simple as possible. However, such lighters present dangers if used by children.

The object of the present invention is to mitigate this drawback by making a lighter more difficult to light so that it can be lighted only after a determined and deliberate operation, and in particular so that a child cannot cause it to light. In general, the invention seeks to increase operating safety for lighters, and also relates to the pushbutton of the lighter.

In order to return the burner automatically towards its closed position, a spring is generally provided beneath the pushbutton with the spring returning the burner to its rest position in which the flow of gas is cut off, with the gas flow channel being closed by a seal.

The spring must be powerful enough to act via the pushbutton and the burner to cause the seal to be pressed adequately against its seat. However, for safety reasons, it turns out that the spring needs to be more powerful than is required for ensuring sealing so as to ensure that there is no danger of accidental lighting due, for example, to the pushbutton bearing against an obstacle inside a pocket.

It is therefore desired for the lighting of a lighter to take place only as a result of a deliberate action on the part of the user requiring a non-negligible amount of force to be applied to the pushbutton. Unfortunately, if the spring is very powerful, then its action is conveyed to the seal in the burner, thereby crushing it and damaging it. This gives rise to leaking which is dangerous and incompatible with normal operation.

A second object of the present invention is to mitigate this drawback and to enable a powerful pushbutton spring to be used without damaging the burner seal.

According to the present invention, the safety lighter including a pushbutton is characterized in that it comprises, beneath the pushbutton, removeable locking means for preventing motion of the pushbutton, said locking means constituting a safety catch or tab, and being capable of being inserted in an opening provided in the rear portion of the pushbutton.

In order to simplify identifying its position, the safety catch is preferably displaceable in a plane perpendicular to the longitudinal midplane of the lighter.

However, after lighting up, the user must return the safety catch to its locking position. Very frequently, this operation will be neglected or forgotten, thereby making the device ineffective since safety is achieved only if it is maintained permanently.

Thus, according to another characteristic of the present invention, the catch is fixed to means for automatically returning it to the locking position. These means may be constituted, for example, by a spring which is tensed when the user moves the catch to the operating position. However, in order to allow the user to light the lighter using one hand only, the front end of the spring may be hooked to a hook, with a cam fixed to the pushbutton or a cam fixed to the catch enabling the spring to be disengaged from the hook, and with the spring being kept tense so long as pressure is applied to the pushbutton.

According to another characteristic of the invention, the pushbutton of a liquified gas lighter is characterized in that its front portion includes a flexible zone and a rigid zone, with a stroke-limiting abutment projecting from the rigid zone towards the body of the lighter.

Contact between the front portion of the pushbutton and the burner head always takes place via the flexible zone which acts somewhat as a shock absorber when transmitting the force released by the pushbutton spring. Thus, the pressure on the seal is made independent of the force of the pushbutton spring, with the rigid zone or portion of the front portion of the pushbutton being stopped by the abutment. It is thus possible to mount a powerful spring on the lighter for satisfying safety requirements but without damaging the seal. For example, the spring may exert a force of 15 newtons to 20 newtons while the force on the burner seal is kept down to 2 newtons or 3 newtons.

Other characteristics and advantages of the invention appear from reading the following description of particular embodiments given purely by way of non-limiting example and with reference to the accompanying drawings, in which:

FIG. 1 is a vertical section through the top portion of a safety lighter in accordance with the invention;

FIGS. 2 and 2*a* are respectively a plan view and a rear view of a lighter in the utilization position;

FIGS. 3 and 3*a* are corresponding views of the same lighter in the safety position;

Figure 1:
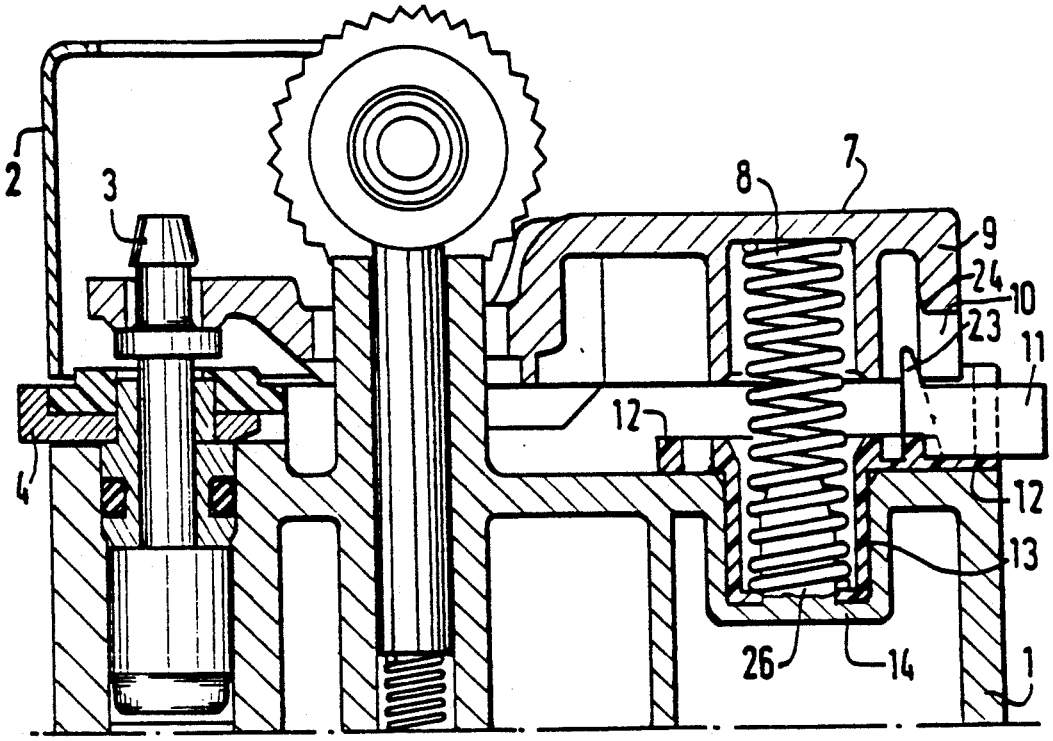

FIG. 1 shows conventional components used in lighter manufacture, and in particular the top end of a lighter body 1, a burner 3, and a knob 4 for adjusting the height of the flame, partially included inside a protective cover 2. The pushbutton 7 is hinged to the body and co-operates with the burner head 3. The pushbutton co-operates with a compression spring 8 disposed between the body 1 and the inside surface of the pushbutton.

Figure 2A:
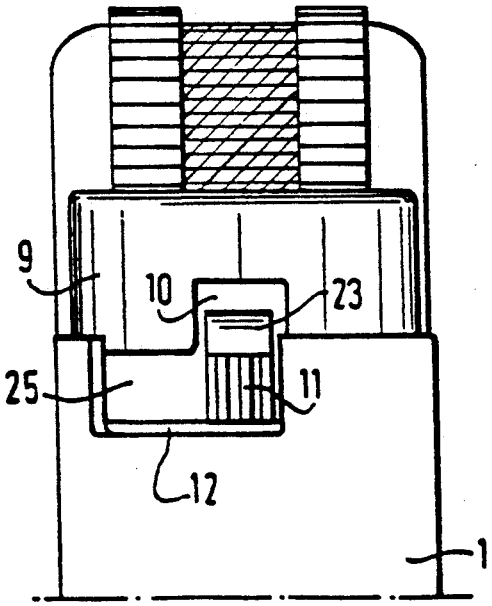

In accordance with the invention, the rear sidewall 9 of the pushbutton includes an opening or notch 10. A catch or lug 11 penetrates into the opening (in FIGS. 1, 2, and 2a which show the lighter in its operating position), said catch 11 being fixed to a ring 12 extending downwards in the form of a hub 13 rotatably received in a cavity 14 of the lighter body, which cavity also serves to receive one of the ends of the spring 8. Thus, as can be seen more clearly in FIGS. 2a and 3a, the catch 11 is free to rotate through an angle of about 60° in a side slot 25 through the sidewall of the lighter body, and preventing operation thereof except when in the position corresponding to the notch 10. The pushbutton 7 is free to move only when the catch is in its position shown in FIGS. 1, 2, and 2a, thereby allowing gas to be released.

Figure 2:
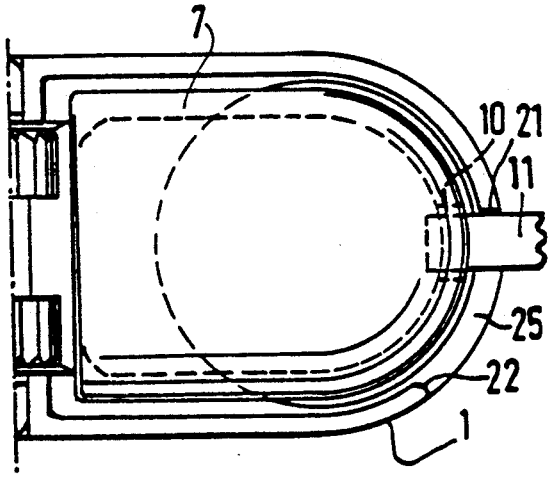
Figure 3A:
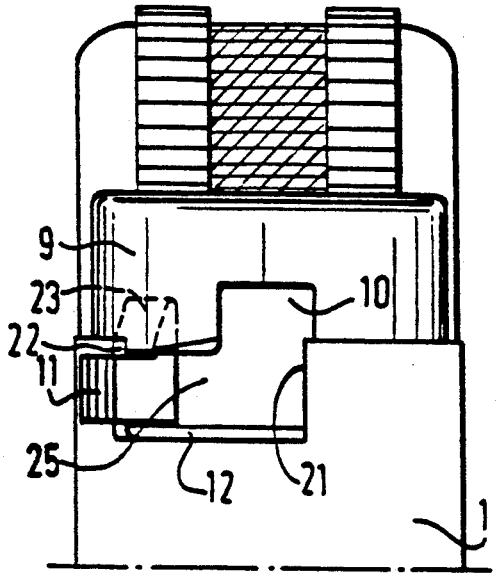
Figure 3:
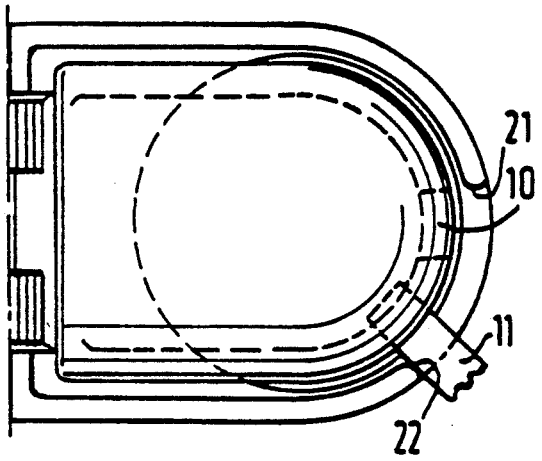

FIGS. 2, 2a, 3, and 3a show a portion of a first embodiment of the lighter seen from above and from behind. FIG. 2 shows that the catch 11 is free to move between two abutment-forming portions of the body 1, bearing respective references 21 and 22 and limiting the stroke of the catch 11. The catch 11 has fluting 27 enabling it to be moved into the desired position.

However, as mentioned above, it is desirable for the lighter to return automatically to the safe position after lighting up. In order to achieve this aim, it is possible to use means as shown in FIGS. 4 and 5, respectively in the operating position and in the safe position, i.e. the position in which has is prevented from flowing by virtue of the pushbutton 7 being locked.

In the example shown, the means for automatically returning the catch to he safe position are constituted by a spiral spring 18 having a central ring 15. The spring 18 is prevented from rotating anticlockwise by a stud 16 or by any other means. In this embodiment, the lug or catch 11 is fixed to the spring 18 and is guided, as before, through a slot or cut-out 25 between the body 1 and the pushbutton 7. The slight ramp may be provided on the pushbutton in order to facilitate engaging the catch 11 beneath the pushbutton when the catch returns to its locking position, thereby assisting the action of the pushbutton spring 8 and the spring 18.

Figure 4:
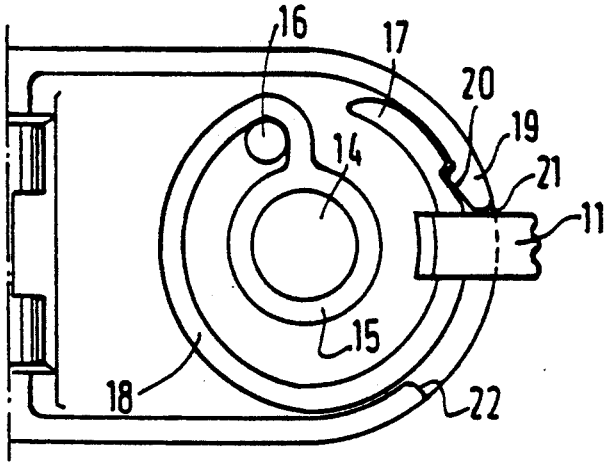
FIG. 4 is a plan view of the rear portion of the lighter, with the pushbutton removed, and showing the latch in the utilization position.
Figure 5:
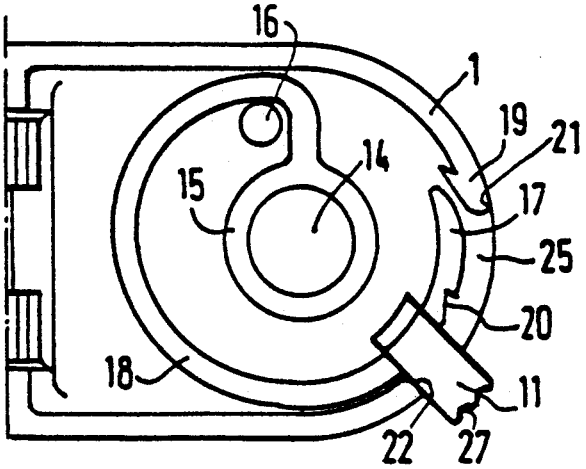
FIG. 5 is similar to FIG. 4, showing the latch in the safety position.

As can be seen in FIGS. 4 and 5, the front portion 17 of the spring 18 has a notch 20, and in the vicinity of the edge 21 of the body there is a hook 19. When the lug 11 is moved to its operating position (FIG. 4), the notch 20 latches behind the hook 19. The lighter is free to operate since its lug 11 is in an appropriate position, i.e. level with the notch 10.

When the user presses down the pushbutton 7, the surface 24 of the pushbutton (FIG. 1) bears against a tooth or cam 23 fixed to the lug 11, thereby urging it forwards, i.e. into the body of the lighter. This movement disengages the notch 20 from the hook 19. However, the cam 23 and the lug 11 remain held in place by the corresponding side of the notch 10. It is only after the pushbutton 7 has returned to its rest position under the action of the spring 8 that the lug 11 can escape into the slot 25, rotating under drive from the spring 18. The position taken up by the various components is then as shown in FIG. 5. Under the action of the spring 18, the lug 11 comes into abutment against the edge 22 of the slot 25, and before the lighter can be used again, the catch or lug 11 must be returned into alignment with the notch 10.

Figure 6:
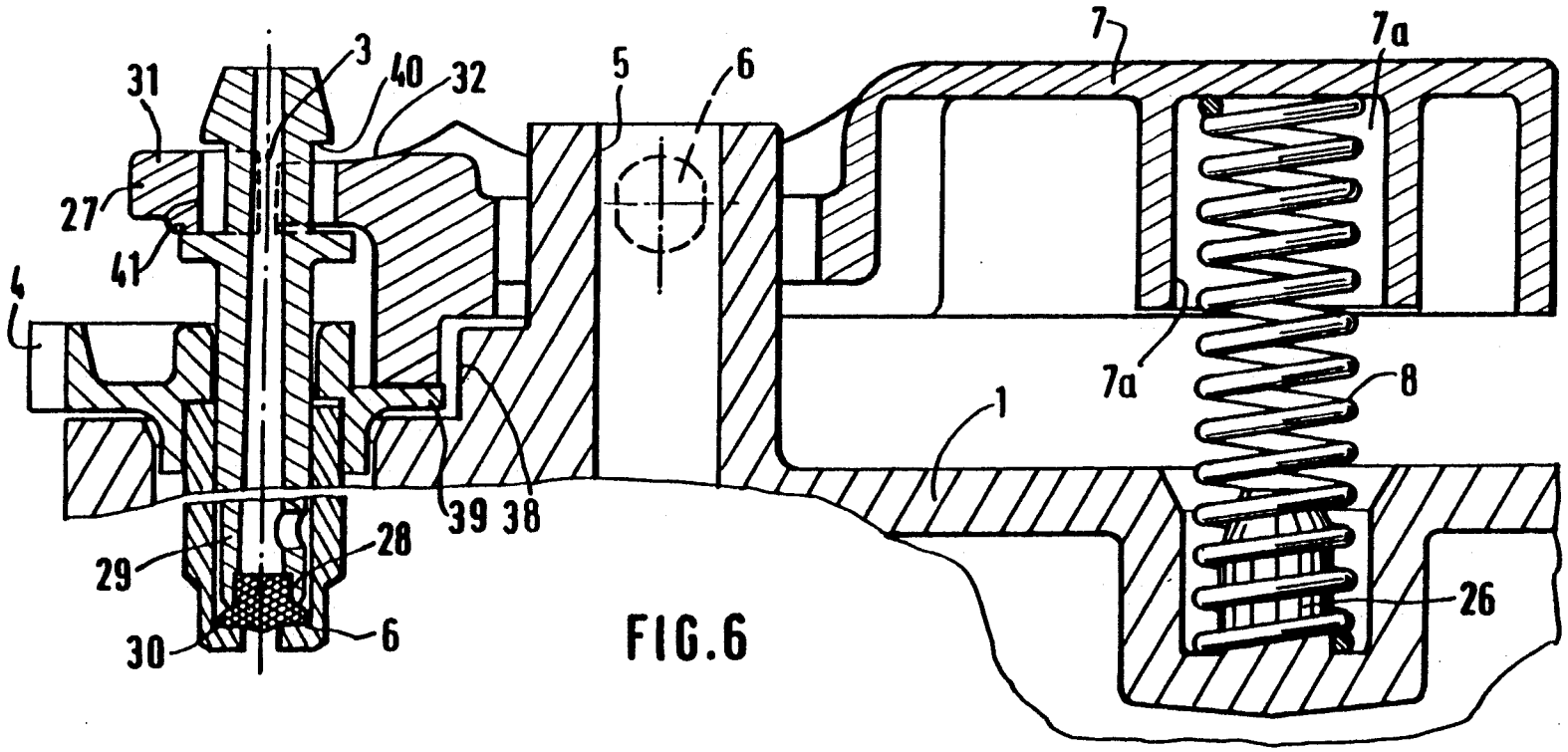
FIG. 6 is a vertical section through the top portion of a gas lighter in accordance with the invention when in its rest position.

In FIG. 6 (from which the safety device has been omitted for reasons of clarity), the lighter body 1 has the following, going from left to right: a passage in which the burner 3 is mounted together with the abutment 4 for adjusting flame height, and a fork 5 for receiving both the striking wheel (not shown) and a pin 6 on which the pushbutton 7 rocks.

The pushbutton 7 engages the compression spring 8 which is imprisoned firstly in a cavity 7a formed in the pushbutton 7, and secondly on a guide stud 26 formed in the body 1. As in the prior art, pressure on the top portion of the pushbutton 7 causes the pushbutton to pivot about its pin 6, thereby raising the front portion 27 of the pushbutton.

The front portion 27 raises the burner head 3, and consequently the entire burner as shown in FIG. 6, thereby lifting the seal 28 which is fixed to the bottom portion 29 of the burner from its seat 30 and allowing gas to flow.

Figure 7:
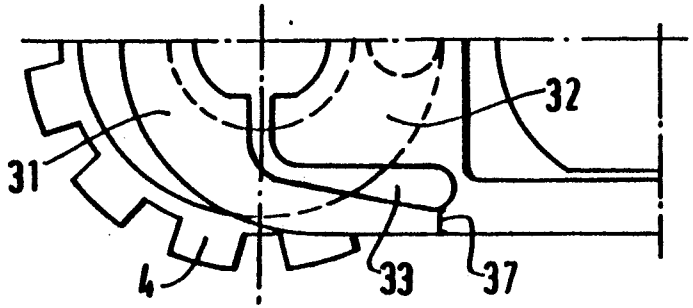
FIG. 7 is a half view in plan of the front portion of the same lighter.

In accordance with a characteristic of the invention, the front portion 27 of the pushbutton 7 is constituted by two zones respectively 31 and 32, which are referred to below as the "flexible" zone 31 and as the "rigid" zone 32. As can be seen in FIG. 7, in the present example, this composite structure comes from a hollow 33 being cut out in the portion 27 ( or being formed therein by molding). Thus, the stiffness of the zone 31 depends only on the mechanical strength of the line 37 at the boundary between the two zones 31 and 32.

An abutment 38 projects downwards beneath the zone 32 to limit the stroke of the front portion 27 of the pushbutton 7. In general, this abutment bears against the body 1 of the lighter. In the example shown, it rests against an extension 39 of the adjustment knob 4.

As can be seen in FIG. 6, the flexible portion 31 has a rim 41 whose function is described below.

A lighter provided with a pushbutton of the invention operates as follows:

After acting on the striking wheel, pressure is exerted on the pushbutton 7, thereby pivoting the pushbutton assembly and raising its front portion 27. The portion 31 of the pushbutton comes into contact with the bottom ring 40 of the burner 3 and raises it, thereby lifting the burner seal off its seat 30 and allowing gas to flow and be ignited. It has been observed that in spite of the resilience of the flexible zone 31, it is nevertheless capable of raising the burner head without difficulty. However, if this is not the case, i.e. if the portion 31 deflects too far, then the rigid zone takes over immediately for applying the required force.

After lighting a cigarette or the like, pressure on the pushbutton is released. Under the action of the previously compressed spring 8, the pushbutton pivots anticlockwise about its pin 6 and its portion 27 moves back down towards its rest position, thereby closing off the flow of gas by means of the burner seal 28. As it moves back down, the burner is driven by the rim 41 on the portion 31, since the rim projects down lower than the bottom surface of the rigid portion 32. This drive continues until the burner seal is pressed against its seat with adequate pressure. The abutment 38 then makes contact with the part 39 and further motion of the rigid portion 32 is prevented. The only pressure exerted on the burner is that from the rim 41, i.e. pressure due to the resilience of the line 37, and as mentioned above this pressure is limited in value.

In general, it is important that the bottom surface of the flexible zone 31 is located at a lower level than the bottom surface of the rigid zone 32. If the flexibility of the zone 31 is sufficient, the abutment 38 for making the end of the stroke of the rigid zone 32 may be omitted. In any event, it is deformation of the flexible zone which transmits the desired pressure to the seal. Naturally, the flexible zone could be a circular central zone projecting beneath the peripheral zone. If the pushbutton of the lighter is provided with a safety catch as mentioned above, it is necessary to leave a certain amount of clearance between the parts in order to allow them to move without friction. This means that the application of pressure on the pushbutton could allow gas to escape even with the safety catch in the safety position. However, the flexibility of the portion 31 deforms and prevents the seal 30 from being lifted off its seat.

The above description is given in the context of a conventional flint lighter. However analogous means could be implemented for piezoelectric lighting, in which case the pushbutton would be a sliding component instead of a rocking component.

I claim:

1. A child resistant safety lighter comprising:

a main body having a chamber of combustible fluid, said chamber having an opening for release of said combustible fluid;

a burner member having a head portion at one end and a sealing means at the other end for sealing said combustible fluid in said chamber, said burner member being movable into and out of sealing engagement with said chamber;

a pushbutton member having a back end and a front end, said pushbutton member being hinged for rotation to said body intermediate its said ends, said front end being operatively connected to said burner and said back end being adapted to rotate toward said body in response to suitable finger pressure applied to its top surface;

a compression spring positioned to bias said pushbutton back end away from said body, whereby said front end automatically rotates toward said main body to lower said burner to the closed sealed position when said back end is released;

locking means for preventing rotation of said pushbutton member to unseal said combustible fluid chamber, said locking means comprising a spring-loaded movable safety tab position between said main body and said back end of said pushbutton member, said safety tab projecting outwardly of said main body and being movable upon application of an external finger force sufficient to overcome the force of said spring from a normally locked interfering position relative to said pushbutton member to an unlocked noninterfering position, said safety tab being movable only in a single plane perpendicular to the rotational plane of said pushbutton member;

said pushbutton back end including a depending backwall which is adapted to engage said safety tab when said tab is in its locked position to prevent rotation of said pushbutton, said backwall having a notch formed therein adapted to accommodate said safety tab when said tab is in its unlocked position, so that said pushbutton member can rotate to raise said burner and unseal said chamber to release said combustible fluid;

said safety tab spring-loading mechanism comprising a spiral spring connected to said safety tab having a fixed end and a free end, said spiral spring being in the relaxed state when said tab is in its locked position and in a tensed state when said tab is in its unlocked position within said notch;

said locking means further comprising tab retention means for holding said safety tab in its unlocked position upon release of said external finger force and tab release means for automatically disengaging said retention means when said pushbutton rear end is depressed to unseal said chamber, said safety tab being forced by its said spring to automatically return to its locked position upon release of said pushbutton; and said main body and said pushbutton back end defining a slot therebetween connecting with said notch for movement of said safety tab between its locked position and its unlocked position within said notch.

2. A child resistant safety lighter according to claim 1 wherein:

said tab retention means comprises a notch formed in the free end of said spiral spring and a mating hook formed in said main body.

3. A child resistant safety lighter according to claim 2 wherein:

said tab release means comprises an upwardly extending inclined cam surface on said safety tab and a mating surface depending downwardly from said pushbutton back end adapted to engage said cam surface and force said spiral spring notch out of engagement with said body member hook as said pushbutton back end is depressed.

4. A child resistant safety lighter according to claims 2, or 3 wherein said compression spring exerts an upward force on said pushbutton back end greater than about 15 newtons.

5. A child resistant safety lighter comprising:

a main body having a chamber of combustible fluid, said chamber having an opening for release of said combustible fluid;

a burner member having a head portion at one end and a sealing means at the other end for sealing said combustible fluid in said chamber, said burner member being movable into and out of sealing engagement with said chamber;

a pushbutton member having a back end and a front end, said pushbutton member being hinged for rotation to said body intermediate its said ends, said front end being operatively connected to said burner and said back end being adapted to rotate toward said body in response to suitable finger pressure applied to its top surface;

a compression spring positioned to bias said pushbutton back end away from said body whereby said front end automatically rotates toward said body to lower said burner to the closed sealed position when said back end is released;

said pushbutton front end including means for dampening the force exerted by said burner sealing means as a result of the force generated by said compression spring on said pushbutton.

6. A child resistant safety lighter according to claim 5, wherein said force dampening means comprises a flexible zone of said pushbutton front end which resiliently transmits the rotational force of said pushbutton to said burner.

7. A child resistant safety lighter according to claim 6, wherein said flexible zone comprises an integral extension of a rigid zone of said pushbutton front end, said flexible zone being positioned to engage bearing surfaces on said burner to raise and lower said burner out of and into sealing engagement with said combustible fluid chamber.

8. A child resistant safety lighter according to claim 5, 6 or 7 wherein:

said force exerted by said pushbutton compression spring is greater than about 15 newtons and the resultant force exerted by said burner sealing means is less than about 5 newtons.

9. A child resistant safety lighter comprising:

a main body having a chamber of combustible fluid, said chamber having an opening for release of said combustible fluid;

a burner member having a head portion at one end and a sealing means at the other end for sealing said combustible fluid in said chamber, said burner member being movable into and out of sealing engagement with said chamber;

a pushbutton member having a back end and a front end, said pushbutton member being hinged for rotation to said body intermediate its said ends, said front end being operatively connected to said burner and said back end being adapted to rotate toward said body in response to suitable finger pressure applied to its top surface;

a compression spring positioned to bias said pushbutton back end away from said body whereby said front end automatically rotates toward said body to lower said burner to the closed sealed position when said back end is released;

locking means for preventing rotation of said pushbutton member to unseal said combustible fluid chamber, said locking means comprising a spring-loaded movable safety tab positioned between said main body and said back end of said pushbutton ember, said safety tab projecting outwardly of said main body and being movable upon application of an external finger force sufficient to overcome the force of said spring from a normally locked interfering position relative to said pushbutton member to an unlocked noninterfering position, said safety tab being movable only in a single plane perpendicular to the rotational plane of said pushbutton member;

said locking means further comprising tab retention means for holding said safety tab in its unlocked position upon release of said external finger force and tab release means for automatically disengaging said retention means when said pushbutton rear end is depressed to unseal said chamber, said safety tab being forced by its said spring to automatically return to its locked position upon release of said pushbutton;

said pushbutton front end including means for dampening the force exerted by said burner sealing means as a result of the force generated by said compression spring on said pushbutton.

10. A child resistant safety lighter according to claim 9, wherein:

said force dampening means comprises a flexible zone of said pushbutton front end which resiliently transmits the rotational force of said pushbutton to said burner.

11. A child resistant safety lighter according to claim 10 wherein:

said flexible zone comprises an integral extension of a rigid zone of said pushbutton front end, said flexible zone being positioned to engage bearing surfaces on said burner to raise and lower said burner out of and into sealing engagement with said combustible fluid chamber.

12. A child resistant safety lighter according to claim 9 wherein:

said pushbutton back end includes a depending backwall which is adapted to engage said safety tab when said tab is in its locked position to prevent rotation of said pushbutton, said backwall having a notch formed therein adapted to accommodate said safety tab when said tab is in its unlocked position, whereby said pushbutton member can rotate to raise said burner and unseal said chamber to release said combustible fluid.

13. A child resistant safety lighter according to claim 12 wherein:

said main body and said pushbutton back end define a slot therebetween connecting with said notch for movement of said safety tab between its locked position and its unlocked position within said notch.

14. A child resistant safety lighter according to claim 13, wherein;

said safety tab spring-loading mechanism comprises a spiral spring connected to said safety tab having a fixed end and a free end, said spiral spring being in the relaxed state when said tab is in its locked position and in a tensed state when said tab is in its unlocked position within said notch.

15. A child resistant safety lighter according to claim 14, wherein:

said tab retention means comprises a notch formed in the free end of said spiral spring and a mating hook formed in said main body.

16. A child resistant safety lighter according to claim 15 wherein:

said tab release means comprises an upwardly extending inclined cam surface on said safety tab and a mating surface depending downwardly from said pushbutton back end adapted to engage said cam surface and force said spiral spring notch out of engagement with said body member hook as said pushbutton back end is depressed.

17. A child resistant safety lighter according to claims 9, 10, 11, 12, 13, 14, 15 or 16 wherein:

said force exerted by said pushbutton compression spring is greater than about 15 newtons and the resultant force exerted by said burner sealing means is less than about 5 newtons.

18. A child resistant safety lighter comprising:

a main body having a chamber of compressed combustible gas, said chamber having an opening including a valve seat for release of said gas;

a burner member having a head portion defining a burning zone at one end and a sealing means at the other end adapted to mate with said seat for sealing said gas in said chamber, said burner member being movable into and out of sealing engagement with said valve seat;

a pushbutton member having a back end with a depending backwall and a front end, formed with a flexible force transmitting zone, said pushbutton member being hinged for rotation to said body intermediate its said ends, with its said front end being resiliently connected to said burner head, said back end being adapted to rotate toward said body in response to suitable thumb pressure applied to its top surface;

a compression spring positioned to bias said pushbutton back end away from said body with a force greater than about 15 newtons whereby said front end automatically rotates toward said main body to lower said burner and seal off said chamber when said back end is released, the rotational force transmitted to said valve seat being reduced by the dampening action of said flexible zone;

locking means for preventing rotation of said pushbutton member to unseal said combustible fluid comprising:

a safety tab integrally connected to a spiral spring within said main body having a free end and projecting outwardly of said main body through a slot formed between said body and said backwall of said pushbutton member, said slot extending in a plane perpendicular to the rotational plane of said pushbutton and communicating at its end with a notch formed in the backwall of said pushbutton, said tab being movable upon application of an external finger force sufficient to overcome the force of said spring from a normally locked interfering position relative to said pushbutton backwall to an unlocked noninterfering position within said notch;

tab retention means for holding said safety tab in its unlocked position within said notch upon release of said external finger force comprising a notch formed in a free end of said spiral spring and a mating hook formed on the interior of said main body; and tab release means for automatically disengaging said retention mean when said pushbutton rear end is depressed to unseal said chamber comprising an upwardly extending inclined cam surface on said safety tab and a mating surface depending downwardly from said pushbutton back end adapted to engage said cam surface and force said spiral spring notch out of engagement with said hook as said pushbutton back end is depressed whereupon said pushbutton front end rotates to lower said burner into sealing engagement with said combustible fluid chamber.

19. A child resistant safety lighter according to claim 18 wherein the force exerted on said valve seat is less than about 5 newtons.

* * * * *

UNITED STATES PATENT AND TRADEMARK OFFICE

CERTIFICATE OF CORRECTION

PATENT NO. : 5,224,854

DATED : July 6, 1993

INVENTOR(S) : Henri Ansquer

It is certified that error appears in the above-indentified patent and that said Letters Patent is hereby corrected as shown below:

In the drawings, Sheet 2, Figure 5, replace reference numeral "27" with --35--.

Title page, column 1, after "Assignee: SIBJET-", replace "Societ',acu/e/" with -- Societé --.

Title page, column 1, after "Foreign Application Priority Data", replace "Jul. 7, 1988" with -- Jul. 1, 1988 --.

Title page, column 1, after "Jul. 11, 1988 [FR] France . . .", replace "88 109387" with -- 88 09387 --.

Title page, column 2, after "4,878,836 11/1989 Nitta ... 431/277", replace "4,885,965" with -- 4,884,965 --.

UNITED STATES PATENT AND TRADEMARK OFFICE

CERTIFICATE OF CORRECTION

PATENT NO. : 5,224,854

DATED : July 6, 1993

INVENTOR(S) : Henri Ansquer

It is certified that error appears in the above-indentified patent and that said Letters Patent is hereby corrected as shown below:

Column 3, line 25, replace "27" with --35--.

Column 5, line 46 (claim 1, line 25), replace "position" with -- positioned --.

Column 6, line 33 (claim 4, line 2), before "2,", insert -- 1, --.

Column 7, line 37 (claim 9, line 27), replace "ember" with -- member --.

Column 10, line 10 (claim 18, line 51), replace "mean" with -- means --.

Signed and Sealed this

Sixteenth Day of August, 1994

*Attest:*

Bruce Lehman

BRUCE LEHMAN

*Attesting Officer*

*Commissioner of Patents and Trademarks*